US005864964A

United States Patent [19]

Barragan

[11] Patent Number: 5,864,964

[45] Date of Patent: Feb. 2, 1999

[54] LONGITUDINAL CONTINUOUS KILN FOR DRYING AND VULCANIZING RUBBER PROFILES

[76] Inventor: Amelia Gomez Barragan, Nuñez de Balboa, 11, Madrid, Spain

[21] Appl. No.: 795,539

[22] Filed: Mar. 17, 1997

Related U.S. Application Data

[63] Continuation-in-part of Ser. No. 508,712, Jul. 28, 1995, abandoned.

[30] Foreign Application Priority Data

Aug. 1, 1994 [ES] Spain ..... 940161

[51] Int. Cl.[6] ..... F26B 25/06

[52] U.S. Cl. ..... 34/212; 34/77; 34/219; 34/224; 34/652

[58] Field of Search ..... 34/477, 480, 467, 34/210, 212, 219, 224, 652, 653, 77

[56] References Cited

U.S. PATENT DOCUMENTS 4,216,592 8/1980 Koch, II ..... 34/68

*Primary Examiner*—John T. Kwon
*Attorney, Agent, or Firm*—Horst M. Kasper

[57] ABSTRACT

A longitudinal continuous kiln (1) for drying and vulcanizing rubber profiles includes a lower chamber (3), provided with a conveying belt (11), and an upper chamber (2), carrying hot air. A plurality of convectors (8) heated by the hot air of the upper chamber (2) are arranged aligned inside the upper chamber (2), each of the plurality of convectors furnished with a diffusing nozzle (9). A conduit with a plurality of unitary derivations (7) branched from the conduit (6) are connected to each of the plurality of convectors (8). Pressurized hot air, heated in the plurality of convectors, is delivered through the conduit (6) and is directed toward the lower chamber (3) for purposes of drying and vulcanizing rubber profiles (10).

13 Claims, 7 Drawing Sheets

LONGITUDINAL CONTINUOUS KILN FOR DRYING AND VULCANIZING RUBBER PROFILES

CROSS-REFERENCE TO RELATED APPLICATIONS

This application is a continuation-in-part application of another application filed Jul. 28, 1995 and bearing Ser. No. 08/508,712, now abandoned. The entire disclosure of this latter application, including the drawings thereof, is hereby incorporated in this application as if fully set forth herein.

BACKGROUND OF THE INVENTION

1. Field of the Invention

The present invention relates to a longitudinal continuous furnace or kiln for drying and vulcanizing rubber profiles with the purpose of allowing the drying and vulcanization of rubber profiles, but which can also be equally well be utilized for performing the drying of products continuously, and in particular of products intended for vehicular purposes and automation. This invention will find application in the industry devoted to the manufacture of longitudinal kilns.

2. Brief Description of the Background of the Invention Including Prior Art

A plurality of furnaces and kilns, be they longitudinal or not, operating in a continuous way, for drying and vulcanizing different products, such as, for example, rubber profiles, are known.

The existing kilns, at least those known to the applicant, do not offer a possibility of effecting an exchange of heat energy of the air mass of an upper chamber to profiles moving within a lower chamber, thus obtaining a heat exchange of the highest efficiency.

It is also noted that the larger part of the longitudinal furnaces employed at present are applied in a way to achieve the desired objective.

Nevertheless, all furnaces and kilns known do not exhibit the possibility to perform an exchange of the thermal energy of the air mass of the upper chamber to the profile which moves in the lower chamber in achieving in the following an exchange with the highest efficiency possible.

Up to the present, the methods employed in the drying and vulcanizing of profiles of synthetic rubber in a continuous way have been:

Continuous vulcanization in chambers made free from nitrates and nitrites.

Vulcanization in a continuous bed with microballs made up of glass compositions.

Continuous vulcanization with microwaves combined with a conventional furnace employing hot air.

Vulcanization on small pillows of sheet metal pieces with hot air.

Furnaces of hot air employed for vulcanization only.

The Koch kiln as disclosed in U.S. Pat. No. 4,216,592 for the drying of coverings.

Of these recited furnaces, the first five employ different processes which are remote from those employed according to the present invention. Perhaps the furnace taught by Koch comes closest to the present invention, even though the Koch kiln exhibits substantial differences from the system of the present invention.

SUMMARY OF THE INVENTION

1. Purposes of the Invention

It is an object of the present invention to provide a kiln for drying and vulcanizing different products, such as rubber profiles, in a continuous way, which allows a heat energy exchange between the air mass of an upper chamber of the kiln and the profiles moving within a lower chamber of the kiln.

These and other objects and advantages of the present invention will become evident from the description which follows.

2. Brief Description of the Invention

The longitudinal continuous kiln for drying and vulcanizing rubber profiles of the invention constitutes a new type of kiln in the field to which the longitudinal continuous kiln relates, since, starting from this field, it is possible to have a kiln fitted with the characteristic that allows the exchange, in a most efficient manner, of the heat of the air mass from the upper chamber to the profile moving within the lower chamber. Special convectors, driven by compressed air, are being used for this operation.

The transfer of heat to a rubber profile to be subjected to vulcanization is necessary in order to achieve the goal of the vulcanization and this object is rapidly obtained when the process meets three conditions:

1. The air has to be compressed and contain a maximum of humidity, with the goal of obtaining the highest specific heat and that the heat contained can be transferred with ease.
2. It is necessary that there exists a largest possible difference in the level of temperature between the heated air, which carries the energy, and the profile to be vulcanized.
3. The rubber profile to be vulcanized has to be exposed to the impact of air as many times as necessary, because the more frequently the molecules of said air, carrying the thermal energy, impact against the profile, the quicker the heat is transmitted. The air has to encircle the profile in a circular way at a large speed and at a large pressure in order to obtain a perfect homogeneity of the transfer of heat to the profile.

It is the express object of this furnace to achieve the vulcanization of profiles of rubber and the grid-like covering of adhesives on the rubber profiles.

It has been noted that the rubber profile, to which the energy has to be transferred in the form of heat, has to be totally surrounded and encircled by the heated air. The molecules of said air, which carry the stored thermal energy, have to impact on the surface of the profile to be vulcanized with the highest frequency possible and for such a time as the profile needs to be vulcanized as required by the mechanical and geometric characteristics of the profile. The air stream has to impact at high pressure and at high temperature in a direction perpendicular to the direction of motion of the profile for this process to obtain in this way a large energy transfer, while the profile passes on the transporting belt.

Compared with the above recited Koch furnace, it is noted that the Koch furnace does not contain Venturi ejectors for directing the hot air onto the profile at high speed and at high pressure. Instead, the furnace of Koch is furnished with openings for the exit of air coming from a ventilator, and for this reason no large pressure is present in the Koch furnace.

This is a fundamental difference between the Koch furnace and the furnace of the present invention, and the Venturi ejectors are necessary in order to obtain the vulcanization of the profiles in an industrial process.

The recited ejectors generate, based on the Venturi effect, a depression in their surroundings, which furnishes an evacuation of the hot air present in the chamber which is disposed above that chamber which carries the rubber profile to be vulcanized, as is presented in detail in connection with the kiln forming the subject matter of the present application.

The furnace of Koch keeps mixing the clean air with air charged with volatile solvents up to a certain predetermined ratio. The furnace of the present invention does not mix at any time the exhaust air of the vulcanization, containing any oils or other particles in a suspension and thereby subject to ignition, with the clean air employed for the vulcanization of the profile. Furthermore, the kiln of the present invention is not subject to any risk of explosion or ignition of the volatile compositions in suspension in the exhaust air of the vulcanization. Therefore, there exists at no point in time a direct contact of these products with the source generating the thermal energy.

The furnace according to the present invention employs, as necessary for its functioning, an installation of compressed air for directing the hot air at a large pressure and a high speed onto the profile. This compressed air, under a pressure of from 2 to 4 atmospheres depending on the mass of the profile to be vulcanized, is completely clean, since at no point in time does it come into contact with the air exhausted from the vulcanization.

This flow of air has to fulfill the characteristics indicated in the process description in order to achieve a quick transfer of the heat to the profile.

The air coming from the vulcanization is employed in accordance with the process of the present invention for passing this exhaust air through a heat exchanger and for preheating the compressed air which is delivered to the ejectors, thereby increasing the thermal efficiency of the kiln of the present invention.

In the chamber of the kiln of the present invention, where the hot air is generated, there is provided a heat exchanger in order to increase the thermal efficiency which heats the fed-in compressed air to a high temperature, and it is this heat exchanger which provides for the evacuation of the hot air in this chamber by way of the ejectors.

The flow of hot air in the kiln of the present invention over the profile and transmitted by the ejectors is uniform over the complete length of the kiln, since the ejectors are disposed at equidistant positions and carry the same pressure of air at each point in time. Valves are employed in the furnace of Koch in order to control the quantity of air projected through the discharge openings, which are not in the form of ejectors.

The furnace of the present invention can reach temperatures of 400 degrees centigrade with as little heating energy installed as 15 to 20 kilowatts based on the heating means employed, such as blowers of hot air, and based on the physical principle of Bernouilli applied to the ejectors.

For that same reason, the invention kiln can achieve an industrial process of continuous vulcanization in a short time span.

The furnace of Koch is not capable of performing an industrial process in a short time span, because the furnace of Koch lacks the ejectors which are capable of projecting the hot air at a high speed and under high pressure, and it is not observed that the object of the present invention could be achieved with the temperatures of the furnace of Koch as compared to the kiln of the present invention. For that same reason, the furnace of Koch is not a kiln capable of vulcanizing rubber profiles.

Based on the foregoing, it can be concluded that the furnace of Koch presents a furnace for the drying of coverings and that no-one could employ the furnace of Koch without modifications, which would affect its operational principle, for an industrial process of continuous vulcanization of rubber profiles.

In a more definite way, the longitudinal continuous kiln for drying and vulcanizing rubber profiles is constructed starting from a continuous kiln of hot air, formed or configured with two chambers, one of them being located at the upper side of the kiln, and the other chamber being placed in the lower side of the kiln. It is a function of this continuous kiln to continuously dry products and, especially, to vulcanize rubber profiles for the automotive industry.

The upper chamber is configured as the chamber carrying hot air, while the lower chamber takes on the task of incorporating the belt conveying the profiles or products to be treated.

Broadly speaking, the longitudinal continuous kiln of the invention is designed for obtaining, in the most efficient manner, an exchange of the air mass from the upper chamber to a profile moving within the lower chamber, for which specially designed convectors are used for said exchange, and wherein the convectors are driven by compressed air. These convectors cause a hot air flow at high speed, which heats both the mass and the surface of the products to a predetermined temperature, depending on the energy introduced into the upper chamber.

A convergence of temperature, time, and speed of the elements to be treated will furnish the purposes desired for the kiln of the present invention.

The kiln is fitted with a device recycling the air from the lower chamber to the upper chamber for being treated and filtered, thereby attaining a high total performance and a great saving of energy.

According to a second embodiment, a non-longitudinal continuous kiln for drying and vulcanizing rubber profiles can be furnished instead of with said chambers, forming an upper chamber and a lower chamber, with more chambers so that these chambers will generate heat or produce the product, which chambers will be in parallel, if desired, in order to increase the production capacity, and then the chambers can be applied to any kind of drying of products and to continuous treatments of products, wherein the chambers are specially constructed for vulcanizing rubber profiles or other elastomers for the automotive or building industries.

In this second embodiment, the lower chamber is the chamber which generates hot air, while the upper chamber contains the belt conveying the profiles or other products to be treated in the longitudinal continuous kiln.

A feature of this second embodiment, with regard to the kiln, consists of exchanging the heat of the air mass from the lower chamber to the profile moving inside the upper chamber in a most efficient manner, wherein orifices communicating between the two chambers are used for this thermal exchange, thereby causing a hot air flow in the upper chamber obtained by pressurized air streams, and wherein the flow of hot air in the upper chamber is utilized for vulcanizing, and wherein the temperature of the hot air flow depends on the energy introduced into the lower chamber.

Pressurized air passes through a collector. The hot air mass from the upper chamber, after being filtered and treated in the collector, is introduced into the lower chamber in order to utilize again a large part of the heat energy of the hot air mass, thereby increasing substantially the performance of the longitudinal continuous kiln.

The continuous longitudinal furnace for drying and vulcanization of profiles disclosed in the present application presents by itself a clear novelty within the field of furnaces to which it belongs and separately from the conventional furnaces. The furnace of the present invention achieves the feature of allowing an interchange of heat with the highest degree of efficiency possible between the air mass of the upper chamber to the profile which moves in the lower chamber and by the feature of employing for this operation special convection equipment activated by compressed air.

More specifically, the continuous longitudinal kiln of the present invention for drying and vulcanizing rubber profiles comprises a continuous furnace of hot air, which is constructed and configured of two chambers, wherein one of the chambers is disposed in an upper area, and wherein the second chamber is disposed in a lower area.

The continuous kiln is used for accomplishing the drying of products in a continuous fashion and especially with the object of attaining a vulcanization of rubber profiles intended for the automotive industries.

The upper chamber is formed as the chamber carrying the hot air, while the lower chamber is intended to include the belt which conveys the profiles or products to be subjected to treatment.

In general, the continuous longitudinal kiln achieves the exchange of the heat of the air mass of the upper chamber with high efficiency to the profile which moves through the lower chamber and for which there are employed some ejectors especially constructed and which ejectors operate on the basis of compressed air. The ejectors achieve in originating a hot air stream of a large speed, which hot air stream heats the surface and the mass of the products to a temperature which is determined depending on the energy which is introduced in the upper chamber.

The co-action of temperature, time, and speed to the elements to be treated furnishes as a result the obtaining of the desired products.

The furnace is furnished with a recycling of the air of the lower chamber to the upper chamber after the air, discharged from the lower chamber, is treated and filtered and, with this recycling, a high overall yield and a large saving of energy are achieved.

The present invention is useful in the context of the production of longitudinal kilns and furnaces.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
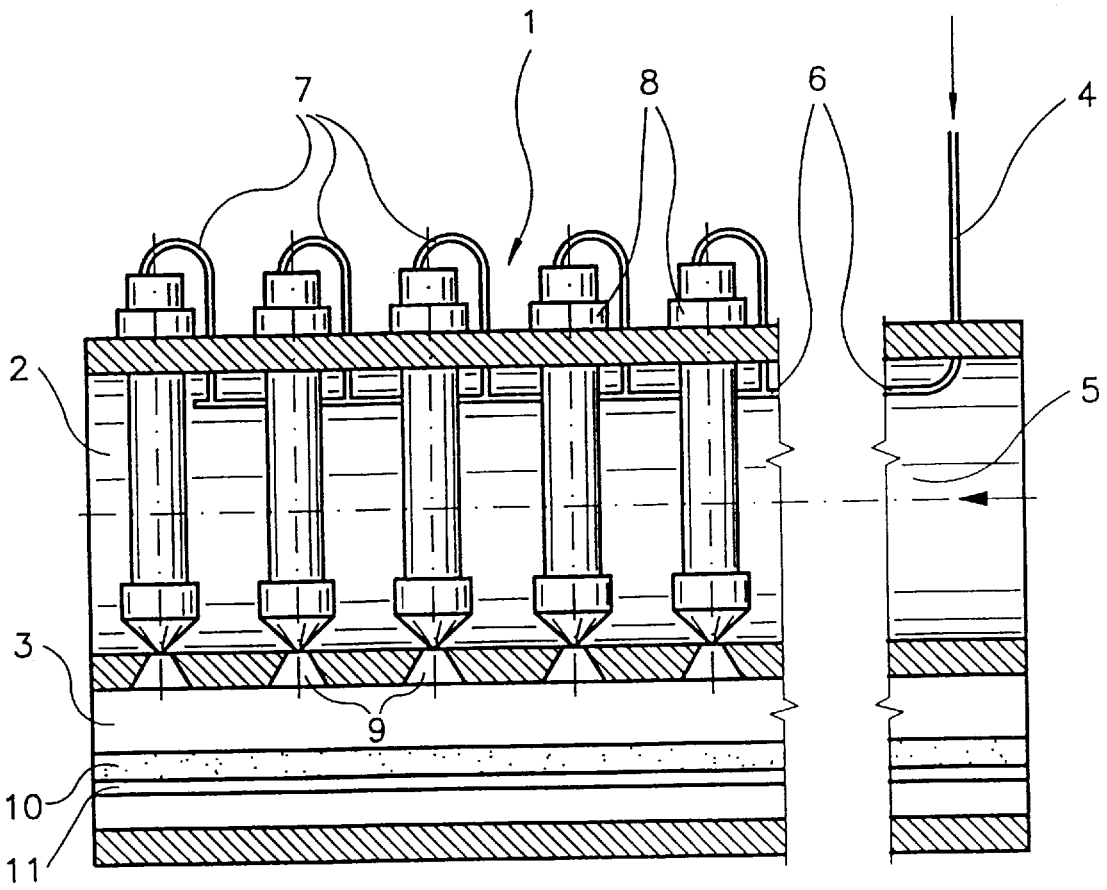
FIG. 1 is a side elevational view of a longitudinal continuous kiln for drying and vulcanizing rubber profiles.

According to the present invention there is provided a longitudinal kiln 1 (shown in FIG. 1) for drying and vulcanizing rubber profiles, where the kiln 1 is formed by an upper chamber and a lower chamber. A plurality of aligned convectors 8 is mounted inside the upper chamber 2. The convectors 8 are connected to each other by a channeling or conduit 6 from which supplementary channelings or conduits 7, representing unitary derivations, emerge and lead to each of the plurality of the convectors 8. Each of the convectors 8 is furnished with a diffusing nozzle 9. Pressurized air is introduced inside the channeling or conduit 6 through an inlet 4. The pressurized air, after being adequately heated by the milieu prevailing in the upper chamber 2, is sent through the diffusing nozzles 9 inside the lower chamber 3, where a profile 10 or element or products to be treated are located on a conveying belt 11 or similar device. The convectors 8 cause a hot air flow at a high speed. The profile 10 is heated by the hot pressurized air flowing with a high speed from the diffusing nozzles 9. The hot pressurized air heats both a surface of the profile 10 as well as the mass of the profile 10 to the desired temperature, depending, of course, on the heat energy introduced into the upper chamber 2. The heat energy is introduced into the upper chamber 2 by the air mass delivered to the upper chamber 2 through an inlet 5. An exchange of heat energy is performed at the convectors 8, where a portion of the heat energy, transferred from the upper chamber 2 into the lower chamber 3, is taken from the air mass of the upper chamber and is sent together with the hot pressurized air, entered into the lower chamber 3, through the diffusing nozzles 9. The profile 10, moving within the lower chamber 3, absorbs a part of the delivered energy. The quantity of energy absorbed by the profile 10 depends on the temperature of the lower chamber 3, the treatment time, and the speed of the profile to be treated.

The kiln 1 can be provided with a device recycling the air mass from the lower chamber 3 to the upper chamber 2 after being treated and filtered. The recycling of the air mass saves heat energy.

Figure 2:
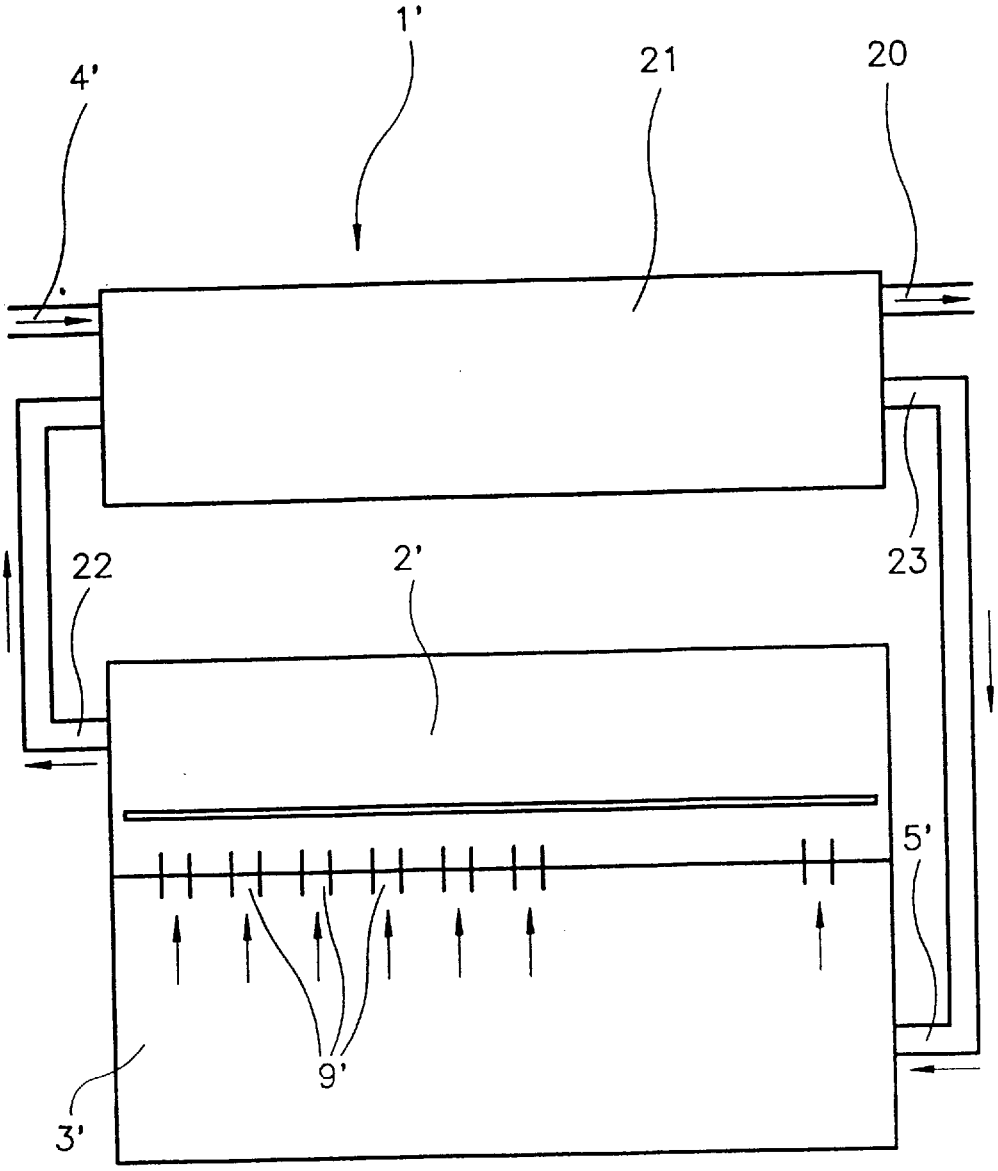
FIG. 2 is a side view of another embodiment of the longitudinal continuous kiln for drying and vulcanizing rubber profiles.
Figure 3:
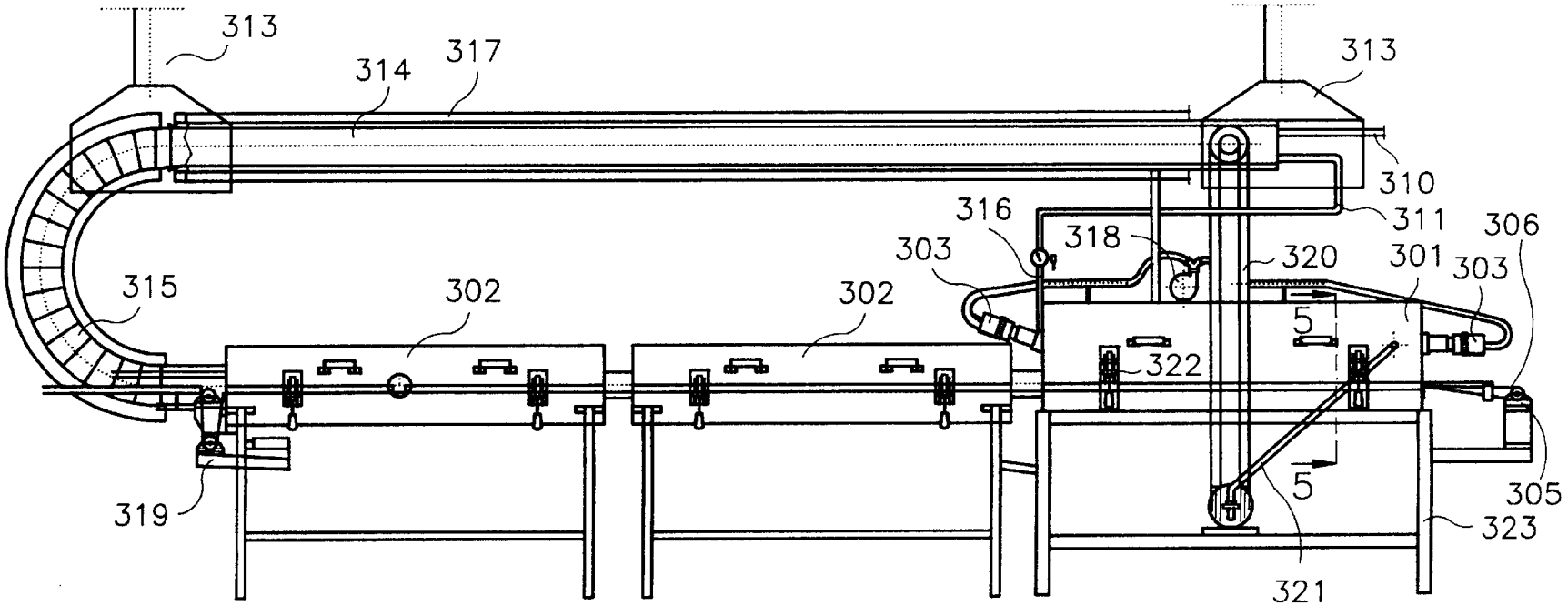
FIG. 3 shows a general view of a continuous longitudinal kiln for drying and vulcanizing rubber profiles.

In a second embodiment, shown in FIG. 2, the longitudinal continuous kiln for drying and vulcanizing rubber profiles 1' is configured as a continuous kiln consisting of two chambers: an upper chamber 21 and a lower chamber 3'. The longitudinal kiln can also have more chambers arranged in parallel, both for generating heat and for conveying the product. This parallel arrangement of chambers will obviously increase the production, and is applicable to every kind of continuous drying and continuous treatment of products, especially for vulcanizing rubber profiles or other elastomers destined in particular for the automotive or building industries.

The lower chamber 3' generates hot air. The upper chamber 21 is provided with a belt (not shown in FIG. 2), conveying profiles (not shown in FIG. 2) or products to be treated. The upper chamber 21 communicates with the lower chamber 3' by some orifices 9'. A pressure, furnished in the lower chamber 3', generates a hot air flow from the lower chamber 3' into the upper chamber 21. A part of heat energy, delivered to the upper chamber 21, is used for heating the profile and for the vulcanizing process. The remaining heat energy stays with the hot air mass in the upper chamber 21. Next, a part of the hot air mass is ducted from the upper chamber 21 through a conduct 22 to a filter, where the hot air mass is filtered and cleaned and then is returned into the lower chamber 3' through the channel 23 and the inlet 5'. Thereby the hot air mass is recycled and the heat energy is saved.

It should also be noted that the filter has an inlet for the pressurized air 4', and an outlet for the clean cold air 20.

The lower chamber 3' is provided with an inlet and an outlet for the profiles, not shown in the drawings.

Based on FIGS. 3 through 6 one can observe how the subject article to be vulcanized passes at a continuous speed from the work chamber 309 (FIG. 4) of the furnace on a transport belt 306.

An electric motor is employed to drive the transport belt 306. Preferably, the electric motor is a variable-speed electric motor.

A prior desired vulcanization temperature is established in the kiln based on the extrusion speed, the discharge speed, and the feed speed of the profile to and through the kiln with the aid of an automatic controller which is presetting the kiln and simultaneously controls the speed of the transport belt 306, in order to predetermine the time period of duration of the profile in the kiln based on a speed changer or on a speed control 305. The speed control 305 is connected to the drive means of the belt 306.

The ventilator of the air flow 318 feeds the two streams of hot air 303 (FIG. 3), which introduce a flow of hot air into the hot air chamber 308 in order to operate the kiln.

At the same time, a compressed air system is placed into operation which induces compressed air to pass through a snake, where the snake is disposed within a tube 314 toward an opening 310. Based on the passing through of the compressed air, this snake is preheated with the gases exhausted from the vulcanization, where the vulcanization takes place in the generating module 301, and where the modules 302 containing the temperature reach to the outside of the snake, where the snake is disposed inside of the tube 314 and across relative to the duct 315.

The transport belt 306 is disposed substantially parallel to the tube 314. The left end of the tube 314 is connected through the duct 315 to the left end and exit port of the work chamber 309.

This compressed preheated air exits from the snake, which is disposed inside the tube 314, through the exit of the compressed air of the upper snake 311, and the preheated compressed air enters the lower snake 307, which lower snake 307 is located inside of the hot air chamber 308, through the entrance 316 of the preheated compressed air.

Figure 6:
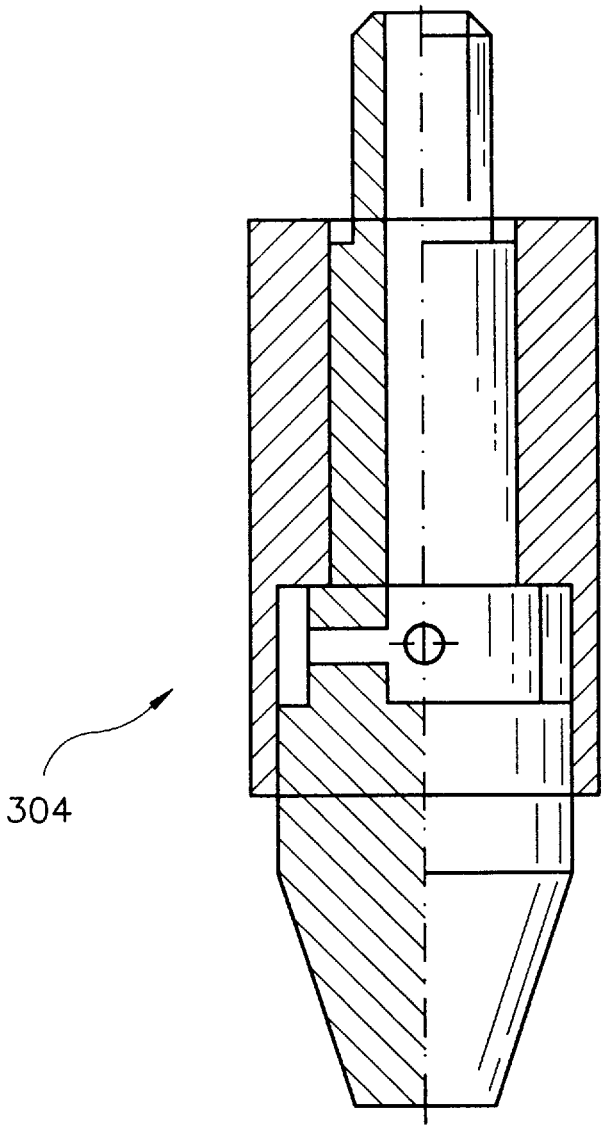
FIG. 6 shows details of one of the ejectors.
Figure 7:
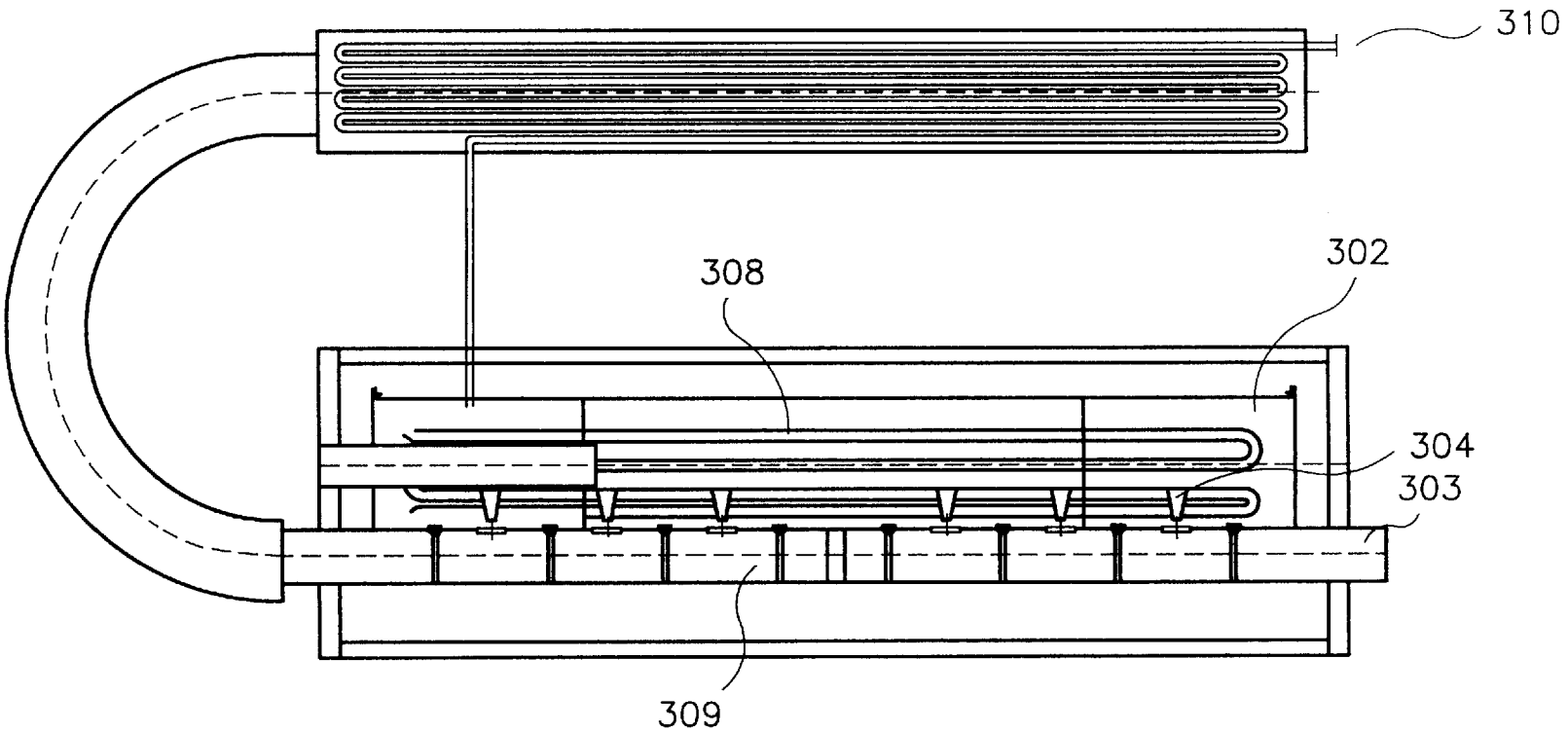
FIG. 7 shows a further general view of a continuous longitudinal kiln for drying and vulcanizing rubber profiles.

The lower snake 307 is disposed inside of the hot air chamber 308 and the compressed air in the interior of the lower snake 307 absorbs the heat generated by the blowers 303 of the hot air and reaches to the blower exit openings of the ejectors 304 (FIG. 6). The upper heat exchanger chamber can also contain electric heaters for providing thermal energy to the compressed air or to the ejectors. The exit openings of the ejectors 304 eject the compressed air into the working chamber 309 through which the profile passes on the transport belt 306.

The working chamber 309 of the kiln preferably operates at temperatures from about 200 degrees celsius to 500 degrees celsius, and more preferred from temperatures of 300 degrees celsius to 400 degrees celsius.

The flow of compressed heated air which is derived from the ejectors 304 carries with itself a part of the hot air which the blowers 303 produce and which also has heated the preheated compressed air which circulates through the lower snake 307 and which apportions the speed of the preheated compressed air. The speed of the compressed air entering the working chamber can be from about 400 to 600 meters per minute. The temperature of the hot air is controlled by thermocouples or other heat sensors. In addition, the temperatures in the working chamber, in the chambers maintaining temperature, in the upper heat exchanging chamber, and in the heat exchanger for preheating the compressed air, are measured by thermal sensors and their temperatures are correspondingly controlled.

The moving profile then receives a stream of hot air, which is mixed with hot compressed air injected by the injectors 304, and of the hot air produced by the blowers 303 and which the stream of compressed air carries up to the working chamber 309, where the profile is disposed. The profile finds itself surrounded by this mass of hot air moving at a high speed, which makes possible the vulcanization of the profile over a short time period and over a short length of the kiln.

Several modules 302 maintaining the temperature of the heated profiles are surrounding the transport belt 306 across from the working chamber 309, wherein the modules 302 maintaining the temperature keep the profile at a high temperature through the majority of time. The modules 302 maintaining the temperature are disposed following the working chamber 9 in transport direction of the transport belt 306. No heat is generated in these modules maintaining the temperature 302; the modules 302 avail themselves only of the heat from the generating module 301 for continuing the profile vulcanization.

After the chambers for maintaining temperature 302, there follows a separation of the waste air from vulcanization from the profiles having been vulcanized. The fumes produced by the vulcanization are then led to the tube 314 through the curved tube 315.

The curved tube 315 is disposed at the exit of the modules maintaining the temperature 302*p*. The curved tube 315 carries the gases of the vulcanization to the tube containing the upper snake 314 and, after preheating the compressed air circulating through the cited upper snake 314, the gases of the vulcanization are released through a cleaning filter, which evacuates the vulcanization gases to the atmosphere.

When the temperature of the generating module 301 assumes a temperature of 400 degrees centigrade, the temperature can reach up to 300 degrees centigrade in the modules 302 maintaining the temperature. This makes a continuous vulcanization process possible over a short distance and with a low energy consumption, which leads to a reduction in the use of electrical energy consumed up to a rate which ranges between 40 percent to 50 percent.

The length of the kiln can be from 15 to 20 meters as compared to a length of from 50 to 60 meters of conventional furnaces employed for the same kind of production processes and the kiln is configured as substantially more functional, versatile, and economical based on its reduced length.

The construction of the present invention includes an upper frame generator module 330 and a lower frame 331 disposed below the generator module 330. The presence of an insulating material 332 is conceived in the lower frame 331 below the generator module and a control system 333 for facilitating the mounting and demounting of equipment, and incorporating a chamber 334 disposed at the location, where the hot air from the hot-air blowers is introduced, is present in the lower frame 331 below the generator module. The lower frame 331 below the generator module further contains an entry port 335 for the hot air delivered by the blowers, as well as the profile to be vulcanized, previously recited. The upper frame 330 of the generator module containing the upper heat exchanging chamber also contains insulating material.

The invention conceives the construction of a system for assuring the tightness and imperviousness 339 in the working chamber, which includes a closing lever 337 and a hinge 338.

In addition, an output port or duct 315 for heated air is provided with structures capable of accepting the heat of the air and allowing filtration of the air, and an entrance port 316 for compressed air to the inner snake of the kiln in order to reach to the ejectors.

A concentric chamber 317 is furnished according to the invention together with the tube of the snake, bringing the heat for heating part of the air which is incorporated into the ventilator of the blowers of air and a ventilator 318 of the blowers of heated air.

Figure 4:
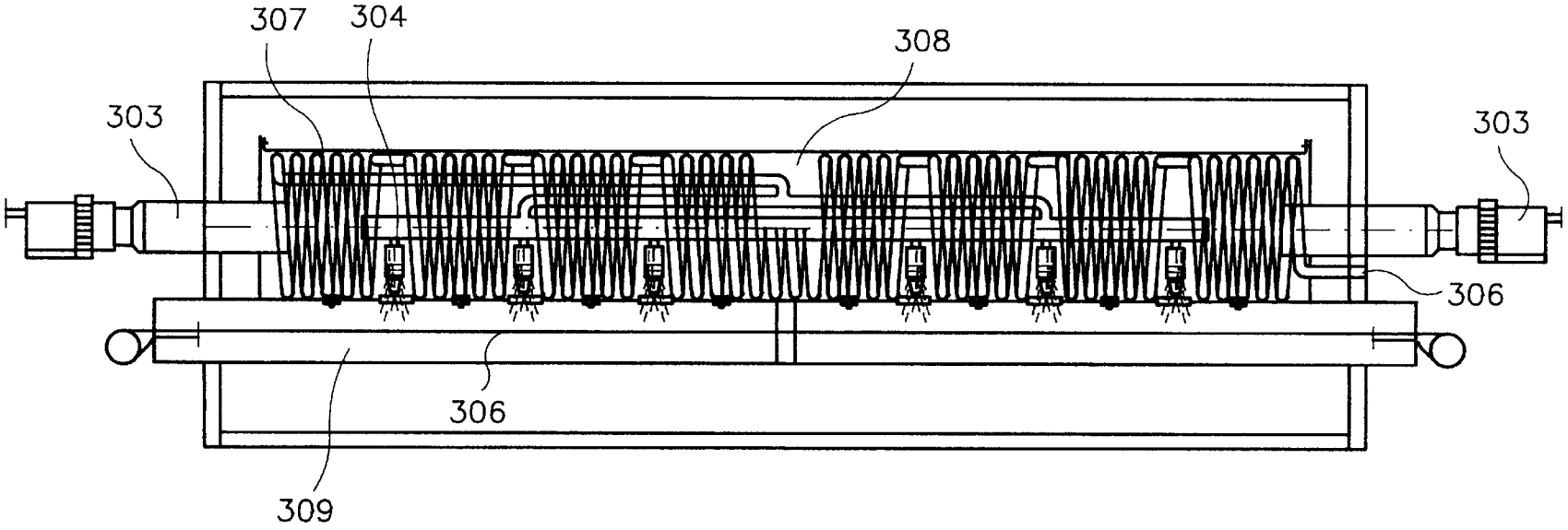
FIG. 4 is a detail view of the generating module according to a sectional view along section lines 4—4 shown in FIG. 3.
Figure 5:
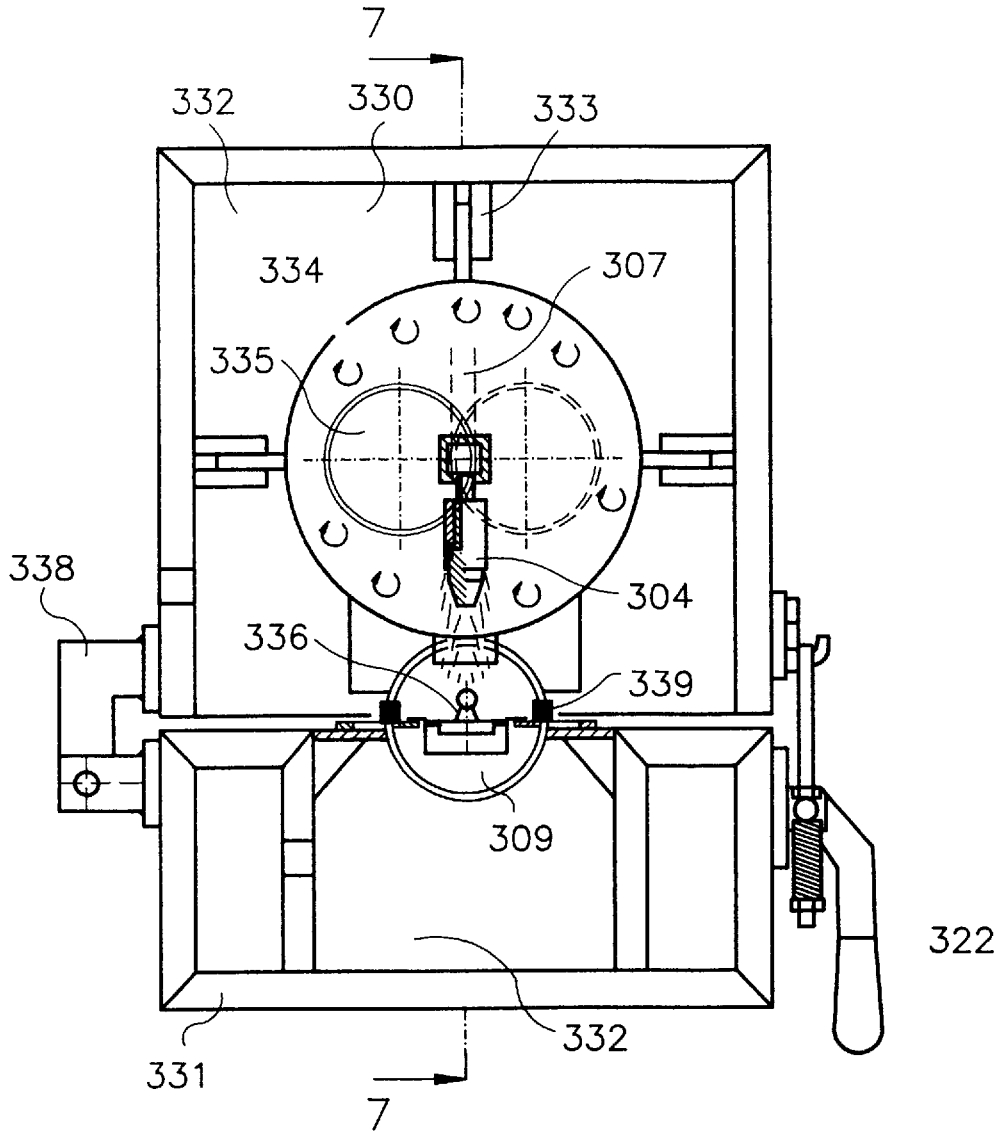
FIG. 5 shows a detail of the generator module along a longitudinal section disposed perpendicular to the section 4—4 mentioned in connection with FIGS. 3 and 4.

FIG. 4 shows the construction of an ejector. The ejector includes an input port shown at the top for receiving hot compressed air and a discharge port shown at the bottom, where the radius of the ejector gradually narrows to accelerate the exit speed of the compressed air into the working chamber 309. In addition, the ejectors provide for the transfer of the hot compressed air from the upper heat exchanger chamber into the lower working chamber 309.

It will be understood that each of the elements described above, or two or more together, may also find a useful application in other types of kilns differing from the types described above.

While the invention has been illustrated and described as embodied in the context of a kiln for drying and vulcanizing rubber profiles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A longitudinal continuous kiln for a continuous drying and vulcanizing of rubber profiles, such as rubber profiles employed in the automotive industry, wherein the kiln comprises an upper chamber (2) capable of sustaining pressure and carrying hot air;

a lower chamber (3) capable of sustaining pressure and containing a belt (11) for conveying a product such as profiles (10) to be treated;

wherein the upper chamber (2) has a plurality of convectors (8) which are arranged aligned inside said upper chamber, fitted with diffusing nozzles (9), there being inside the convectors (8) a pressurized air flow through an inlet (4), which, by means of a conduit (6), is incorporated, by means of unitary derivations (7), into each of the convectors (8), the pressurized hot air at a predetermined temperature emerging toward the lower chamber (3) via a plurality of diffusers (9).

2. The longitudinal continuous kiln for drying and vulcanizing rubber profiles according to claim 1, wherein the kiln exchanges the heat of an air mass of the upper chamber (2) to the profile (10) moving on the conveying belt (11) inside the lower chamber (3), the product (10) receiving a hot air flow at high speed emerging from the diffusers (9), heating both a surface and the mass of products (10) at the desired temperature depending on the energy introduced into the upper chamber (2), the kiln having a device for recycling the air of the lower chamber (3) to the upper chamber (2), after being treated and filtered, the air entering the chamber (2) through an inlet (5).

3. The longitudinal continuous kiln for drying and vulcanizing rubber profiles according to claim 1, characterized in that the upper chamber (21) and the lower chamber (3') are aligned with a plurality of chambers, both for generating heat (21) and for conveying (3') the product (11), arranged in parallel, the lower chamber (3') being the one generating hot air, and the upper chamber (21) containing the belt (11) conveying the profiles or products (10) to be treated.

4. The longitudinal continuous kiln for drying and vulcanizing rubber profiles according to claim 3, wherein heat of the air mass from the lower chamber (3') falls on the profile (10) moving within the upper chamber (21), by using some perforations (9') communicating both chambers (21) and (3'), causing pressurized air streams producing a flow of hot air in the upper chamber (21) which is utilized for vulcanizing, depending on the temperature of the energy introduced into the lower chamber (3').

5. The longitudinal continuous kiln for drying and vulcanizing rubber profiles according to claim 4, wherein the kiln recycles the hot air mass from the upper chamber (21) to the lower chamber (3'), after reconducting the hot air over a channeling (22) to a filter, in which the hot air is cleaned and filtered being reconducted over a conduit (23) until an inlet (5') connected with the lower chamber (3'), the filter having an inlet for the pressurized air (4'), and an outlet for the clean and cold air (20).

6. A longitudinal continuous kiln for drying and vulcanizing rubber profiles comprising a lower chamber;

a conveying belt disposed in the lower chamber for conveying rubber profiles to be treated;

an upper chamber carrying hot air;

a plurality of convectors heated by the hot air of the upper chamber and arranged aligned inside the upper chamber, wherein each one of the plurality of convectors is furnished with a diffusing nozzle at a first end of said each one of the plurality of convectors, said each one of the plurality of convectors inserted in the lower chamber with the first end furnished with the diffusing nozzle and directed with the diffusing nozzle toward the belt conveyer conveying the rubber profiles; and a conduit having an inlet and furnished with a plurality of unitary derivations branched from the conduit, with each of the plurality of unitary derivations connected to a second end of said each one of the plurality of convectors, wherein pressurized hot air heated in the plurality of convectors and delivered through the conduit is directed toward the lower chamber for purposes of drying and vulcanizing rubber profiles.

7. The longitudinal continuous kiln according to claim 6, wherein an exchange of heat energy between the hot air of the upper chamber and the rubber profiles, placed on the conveying belt moving within the lower chamber, occurs when a hot air flow at high speed, emerging from the diffusers, heats both surfaces and mass of the rubber profiles at a desired temperature depending on energy introduced into the upper chamber.

8. The longitudinal continuous kiln according to claim 6, further comprising a device for recycling air from the lower chamber to the upper chamber after being treated and filtered, wherein the air enters the chamber through an inlet.

9. The longitudinal continuous kiln according to claim 6, the upper chamber and the lower chamber are aligned with a plurality of chambers arranged in parallel, serving either for generating heat or for conveying products.

10. A longitudinal continuous kiln for drying and vulcanizing rubber profiles, comprising an upper chamber;

a conveying belt disposed in the upper chamber for conveying rubber profiles to be treated;

a lower chamber carrying hot air;

perforations connecting the upper chamber and the lower chamber, wherein the perforations connecting the upper chamber and the lower chamber are causing pressurized air streams producing a flow of hot air in the upper chamber, which is utilized for vulcanizing depending on the temperature of the energy introduced into the lower chamber, and wherein the hot air from the lower chamber falls on the profiles moving within the upper chamber.

11. The longitudinal continuous kiln for drying and vulcanizing rubber profiles according to claim 10, further comprising means for recycling the hot air from the upper chamber to the lower chamber after returning the hot air over a channeling and through a filter, wherein the hot air is cleaned and filtered in the filter and being reconducted over a conduct to an inlet connected to the lower chamber, and wherein the filter additionally includes an inlet for pressurized air and an outlet for clean and cold air.

12. The longitudinal continuous kiln for drying and vulcanizing rubber profiles according to claim 10, further comprising a device for recycling air from the lower chamber to the upper chamber after being treated and filtered, wherein the air enters the chamber through an inlet.

13. A longitudinal continuous kiln for drying and vulcanizing comprising a transport belt for carrying profiles to be vulcanized;

a working chamber surrounding the transport belt for passage of hot air capable of delivering heat to the profiles on the transport belt;

ejection nozzles penetrating into the working chamber for delivering compressed hot air to the working chamber;

an upper heat exchanger chamber disposed above the working chamber and supporting the nozzles;

compressed air piping disposed in the upper heat exchanger chamber connected to the ejectors blowers for hot air connected to the upper heat exchanger chamber for delivering hot air to the upper heat exchanging chamber and wherein the hot air placed into the upper heat exchanging chamber transfers the heat to the compressed air;

a heat exchanger for preheating compressed air containing a tube connected at a first end to an exhaust of the working chamber and connected at a second end to a waste air discharge and containing a pipe disposed in the tube and carrying compressed air wherein the pipe carrying compressed air at a first end is connected to the compressed air piping in the upper heat exchanger chamber and at a second end connected to a source of compressed air.

* * * * *